US006446849B1

(12) United States Patent
Schleifer

(10) Patent No.: US 6,446,849 B1
(45) Date of Patent: Sep. 10, 2002

(54) CARRYING DEVICE

(76) Inventor: Jason E. Schleifer, 5215 Lerner Hall, New York, NY (US) 10027

( * ) Notice: Subject to any disclaimer, the term of this patent is extended or adjusted under 35 U.S.C. 154(b) by 0 days.

(21) Appl. No.: 09/878,008

(22) Filed: Jun. 8, 2001

Related U.S. Application Data

(60) Provisional application No. 60/212,965, filed on Jun. 21, 2000.

(51) Int. Cl.[7] ..... A45F 3/14

(52) U.S. Cl. ..... 224/258; 224/609; 294/149

(58) Field of Search ..... 224/257, 609, 224/258, 638; 294/149

(56) References Cited

U.S. PATENT DOCUMENTS

| | | | | | |
|---|---|---|---|---|---|
| 650,909 | A | * | 6/1900 | Rawlings | 224/257 |
| 1,140,585 | A | | 5/1915 | Euson | |
| 3,587,951 | A | | 6/1971 | Derouin | |
| 4,483,470 | A | | 11/1984 | Cousins | |
| 4,790,462 | A | | 12/1988 | Kawaguchi | |
| 4,815,642 | A | | 3/1989 | Ray | |
| 4,976,388 | A | * | 12/1990 | Coontz | 224/264 |
| 4,978,044 | A | * | 12/1990 | Silver | 224/202 |
| 5,129,560 | A | * | 7/1992 | Herman | 224/151 |
| 5,285,939 | A | | 2/1994 | Hogan | |
| 5,292,042 | A | | 3/1994 | Yamaguchi et al. | |
| 5,292,044 | A | * | 3/1994 | Reimers | 224/264 |
| 5,307,967 | A | * | 5/1994 | Seals | 224/257 |
| 5,335,835 | A | | 8/1994 | Hogan | |
| 5,425,485 | A | | 6/1995 | Carlo | |
| 5,513,787 | A | | 5/1996 | Reed | |
| 5,540,367 | A | * | 7/1996 | Kauker | 224/269 |
| 5,690,261 | A | | 11/1997 | Moore | |
| 5,853,213 | A | | 12/1998 | Simpson | |
| 5,890,227 | A | * | 4/1999 | Brown | 2/102 |

* cited by examiner

*Primary Examiner*—Stephen P. Garbe
(74) *Attorney, Agent, or Firm*—Frishauf, Holtz, Goodman & Chick, P.C.; Robert P. Michal

(57) ABSTRACT

A carrying device includes an elongated strap having first and second ends, at least one clamp at least proximally coupled to one of the first and second ends of said elongated strap, and a securement device coupled to a region proximate at least one of the first and second ends of said elongated strap for coupling together the regions proximate the first and second ends of the elongated strap.

8 Claims, 3 Drawing Sheets

1
16
2
4
4
6
6
15
6
12
10
6
14
8
8

CARRYING DEVICE

CROSS-REFERENCE TO RELATED APPLICATIONS

The present application claims priority under 35 USC 119(e) of U.S. Provisional Application Ser. No. 60/212,965 filed Jun. 21, 2000, the entire disclosure of which is incorporated herein by reference.

FIELD OF THE INVENTION

The present invention relates to carrying devices, and more particularly to a carrying device for holding and carrying various items such as skates and shoes.

BACKGROUND INFORMATION

The roller skating industry has experienced a resurgence within the last decade with the popularity of in-line skating. In-line skating is often used as a means of transportation to get from one place to another instead of for merely circuitous trips (e.g. exercise). Often when in-line skating is used as a means of transportation, the person carries his street shoes so that he can change into the shoes upon arrival at the destination. This presents two problems. First, the person must carry his shoes while wearing the skates, and secondly the person must carry his skates while wearing the shoes.

Frequently, skaters tie the laces of the shoes together and carry the shoes over one shoulder while skating. Likewise, once the person arrives at the destination and puts on the shoes, the skate laces are tied together in order to carry the skates over the person's shoulder. This method of carrying skates and shoes has disadvantages. Skaters frequently move their arms when they skate to maintain balance and to increase speed. When skates or shoes are slung over a shoulder, these items tend to swing with the person's motion. This swinging of the skates or shoes is disruptive. Even further, the skates or shoes can slip off of the person's shoulder due to the person's movement. It is important for a skater to keep his arms and shoulders free of obstruction so as not to affect his skating. Slinging shoes over the shoulder obstructs arm and shoulder motion and generates an imbalance in the skater, thereby increasing the likelihood that the skater will fall. If the skater were to fall, injury is likely.

Bags for storing skates have been introduced. These bags, however, must be either carried by hand or by a shoulder strap and therefore suffer from some of the same aforementioned disadvantages of carrying skates or shoes over the shoulder.

Backpacks have also been introduced for carrying skates or shoes. Even though backpacks need not be carried by hand, the backpack is cumbersome, restricts arm movement which is detrimental to a skater, and raises a skater's center of gravity thereby increasing the likelihood of a fall.

OBJECTS AND SUMMARY OF THE INVENTION

It is therefore an object of the present invention to provide a device for carrying skates and shoes over a person's shoulders without having the skates or shoes swing due to the person's movement while skating or walking.

It is another object of the present invention to provide a skate and shoe carrying strap which overcomes the inherent disadvantages of known carrying devices.

In accordance with one form of the present invention, a carrying device includes an elongated strap having first and second ends, at least one clamp at least proximately coupled to one of the first and second ends of said elongated strap, and a securement device coupled to a region proximate at least one of the first and second ends of said elongated strap for coupling together the regions proximate the first and second ends of the elongated strap.

In accordance with another form of the present invention, a method of using a carrying strap includes the steps of placing the carrying strap about a user's neck, securing an item to be carried to at least one end of the carrying strap and coupling portions of the carrying strap proximate the ends of the carrying strap to itself, the carrying strap being behind the user's back to secure the carrying strap about the user's body and to prevent the item being carried from swinging about the user's body.

A preferred form of the present invention as well as other embodiments, objects, features and advantages will be apparent from the following detailed description of illustrative if embodiments, which is to be read in connection with the accompanying drawings.

DETAILED DESCRIPTION OF THE PREFERRED EMBODIMENT

Figure 2:
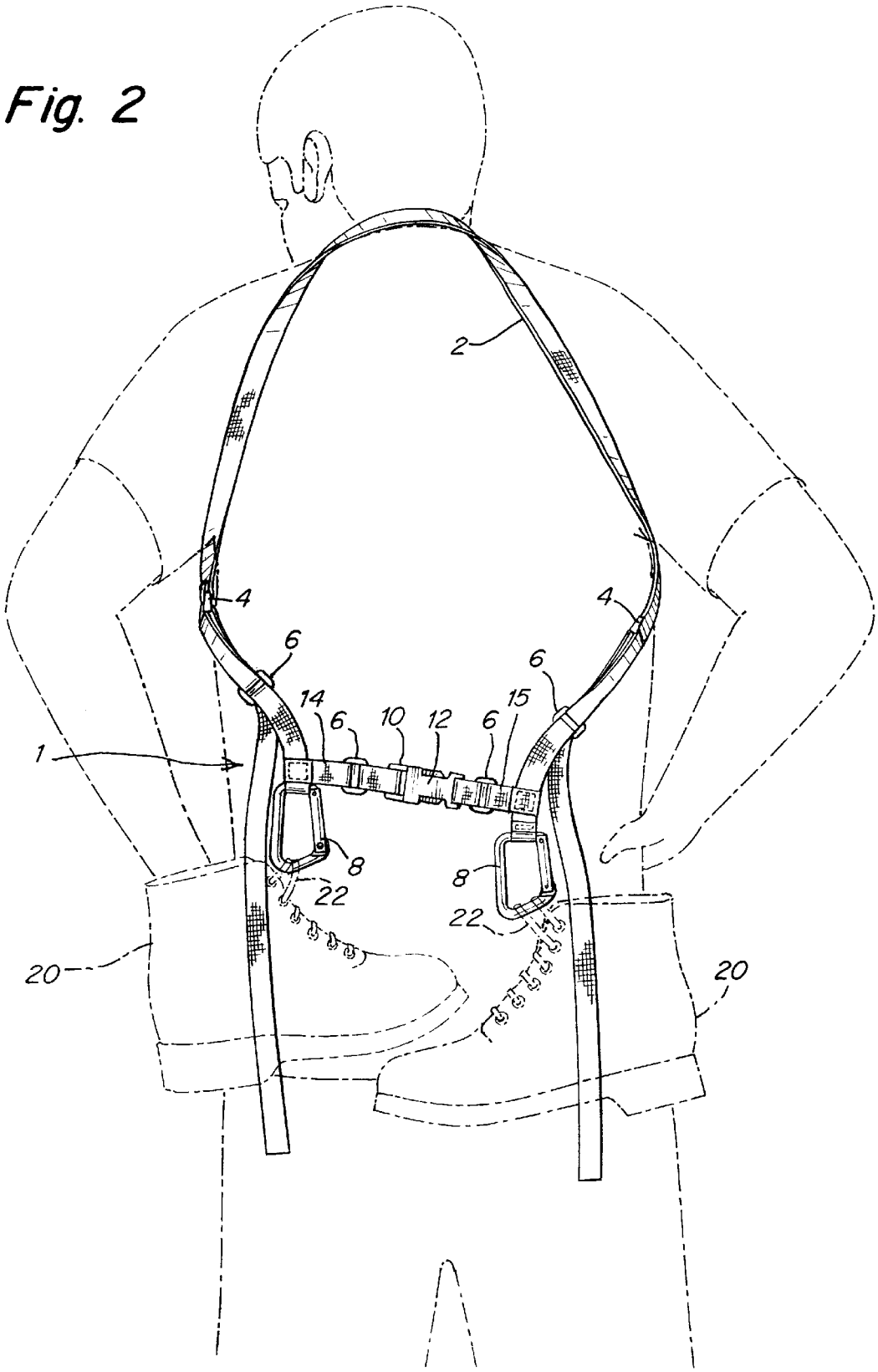
FIG. 2 is a perspective view of the carrying device of the present invention with the strap passing under the user's arm pits and being secured behind the user's back.
Figure 3:
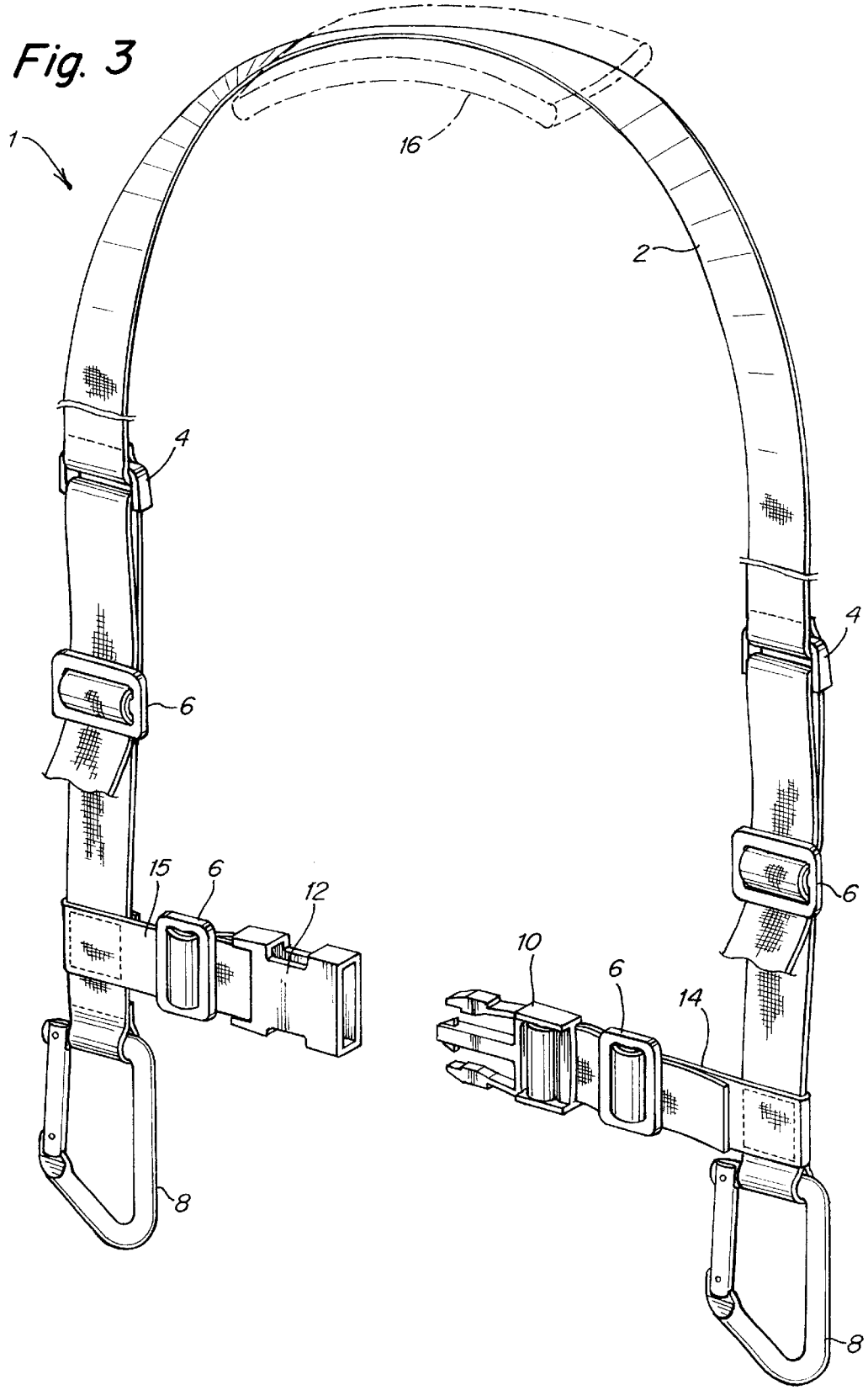
FIG. 3 is a perspective view of the carrying device of the present invention in the unsecured state.

Referring initially to FIG. 3, the carrying device of the present invention is shown. The device includes a strap 2. The strap is preferably made of a high grade nylon, but may be made of any durable and flexible material such as, for example, leather, cloth, plastic, vinyl or synthetic leather. The strap can also be made from a combination of these materials. The strap can include a single piece of material or many pieces of material which are attached together by means of clips 4. The strap is preferably adjustable so at to conform to the user's needs. In the preferred embodiment, in order to adjust the length of the strap, frictional snubbing devices 6 (i.e., adjustable buckles) are included to adjust the length of the strap on either end thereof. Attached to each end of the adjustable strap is a clamp 8 for coupling an item (e.g., a skate or shoe, see FIGS. 1 and 2) to the strap 2. The clamps are preferably carabiners because of their strength and durability. Although carabiners are preferred, any type of closable hook or clamp can be used to secure an item to the strap 2.

Coupled near the distal end portion of each end of the adjustable strap are buckles 10, 12. The buckles are preferably secured to the strap 2 by adjustable straps 14, 15 which are secured to the distal ends of the strap 2. Preferably a male buckle 10 is secured via adjustable strap 14 to one end of the strap 2, and a female buckle 12 is secured via adjustable strap 15 to the other end of the strap 2 so that the male and female buckles can be coupled together to secure the ends of the strap 2 together.

The strap 2 may also include a pad 16 which serves to cushion the strap against the user so that the strap does not cause the user a great deal of discomfort while the carrying device is being worn. The pad prevents the main adjustable strap from excessively "digging in" to the user's body and prevents the strap from slipping or rotating while secured to a user.

Figure 1:
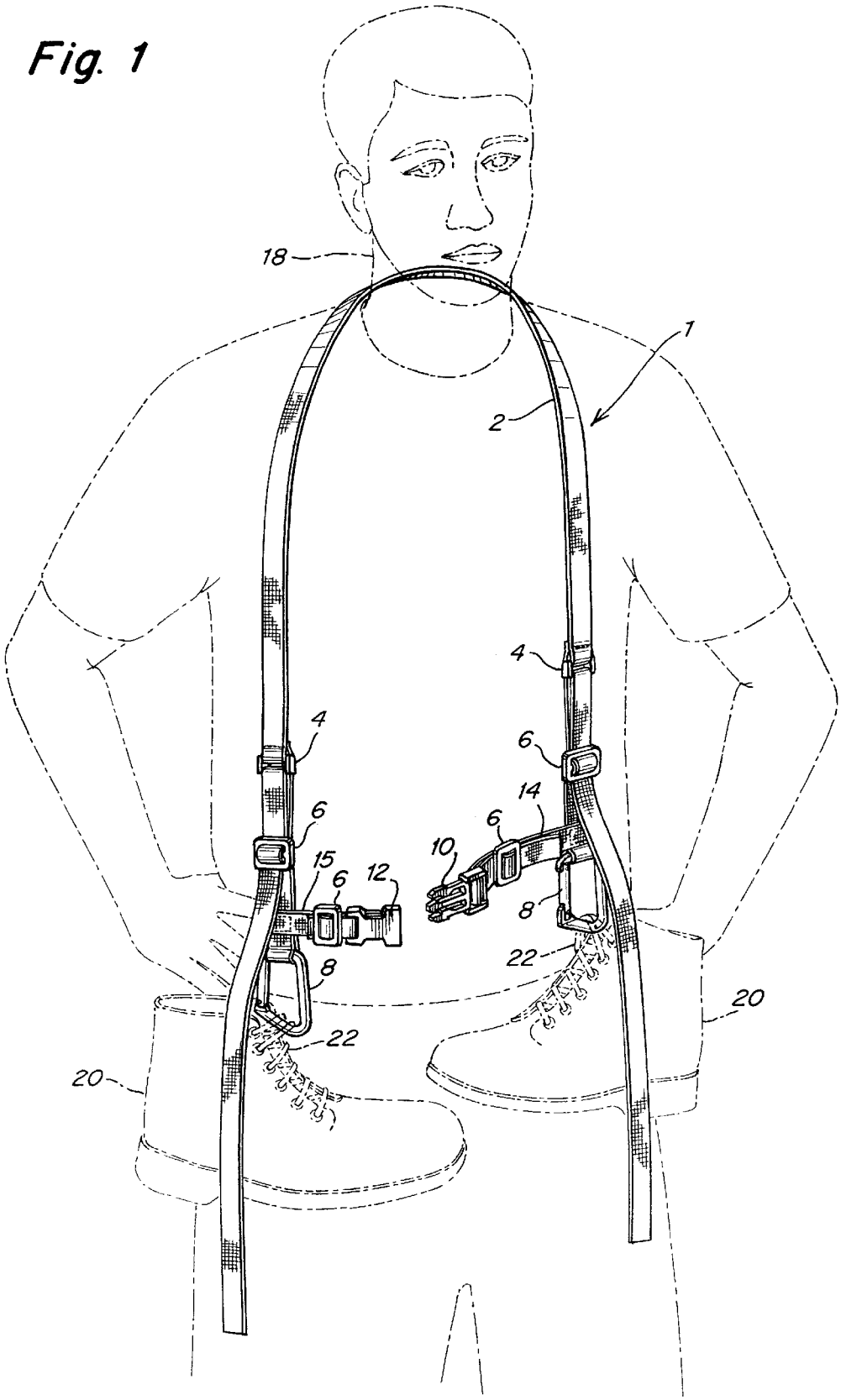
FIG. 1 is a perspective view of the carrying device of the present invention draped around a user's neck.

Referring now to FIG. 1 of the drawings, the carrying device 1 is shown about a user's neck (the user being shown in phantom). As shown in the figure, the carrying device is secured behind the user's neck 18 and shoes 20 are attached to the clamp 8 via the shoe laces 22. The male and female buckles 10, 12 are unsecured in FIG. 1. However, when they are secured such that the shoes are proximate the user's belly, the shoes will not significantly move about the user's body so as not to become a distraction during skating. The shoes will not swing a great deal due to straps 14, 15 being connected at the ends of strap 2 and being connected together via buckles 10, 12.

Referring now to FIG. 2, an alternative use of the carrying strap is shown. In FIG. 2 the strap is placed about the user's neck, over and to the front of the user's shoulder and under the user's arm pit. The buckles 10, 12 are secured together behind the user's back. As a result, when the user exhibits a great deal of motion such as when inline skating, the shoes will not interfere with the skater's movement because they are behind the user's back.

It is also foreseen that the carrying strap could be draped over one shoulder of the user. Thereafter the buckles 10, 12 are secured together, such that the swinging movement of the items attached to the clamps 8 is limited. However, it is preferred that device be secured about the user's body such that the strap 2 is taut so the attached items do not have the freedom to swing freely.

Although illustrative embodiments of the present invention have been described herein with reference to the accompanying drawings, it is understood that the invention is not limited to those precise embodiments and that various changes and modifications may be affected therein by one of ordinary skill in the art. For example, while shoes are shown in the drawings, it is clear that the preset invention can be used in connection with in-line skates, roller skates and ice skates, or other items capable of being secured via the clamps. The skates can be coupled via their laces or via the bottom of the skate. While the invention was discussed specifically in relation to in-line skating, it is foreseen that the present invention could be used in other activities where it is important to prevent obstruction and interference of arm movement (e.g., rock climbing, cycling, skate boarding, riding a scooter). Moreover, while the strap 2 is preferably adjustable, it need not be adjustable and it need not be a strap but could be a cord or rope.

What is claimed is:

1. A carrying device comprising:

an elongated strap having first and second ends;

first and second clamps at least proximally coupled to the first and second ends of said elongated strap and holding separate items; and a securement device coupled to a region proximate at least one of the first and second ends of said elongated strap for coupling together the regions proximate the first and second ends of the elongated strap, wherein said securement device comprises first and second securement straps and a joining member respectively coupled to said first and second securement straps for joining said first and second securement straps to prevent the items secured to the first and second clamps from freely swinging when the device is worn by a user.

2. The carrying device according to claim 1 wherein the carrying strap further comprises a cushion or pad coupled thereto.

3. The carrying device according to claim 1 wherein at least one of the first and second clamps is a carabiner.

4. The carrying device according to claim 1 wherein a length of the elongated strap is adjustable.

5. The carrying device according to claim 1 further comprising an adjustable buckle coupled to the elongated strap for adjusting a length of the elongated strap.

6. The carrying device according to claim 1 wherein the elongated strap is made from one of nylon, leather, cloth, plastic, vinyl, and synthetic rubber.

7. A method of using a carrying strap comprising the steps of:

placing the carrying strap about a user's neck;

securing an item to be carried to at least one end of the carrying strap; and coupling portions of the carrying strap proximate the ends of the carrying strap to itself, the carrying strap being behind the user's back to secure the carrying strap about the user's body and to prevent the item being carried from swinging about the user's body.

8. The method of using a carrying strap according to claim 7 further comprising the step of:

passing the carrying strap under the user's arm pits prior to securing the carrying strap behind the user's back.

* * * * *